US005201590A

United States Patent [19]

Hakkaku et al.

[11] Patent Number: 5,201,590

[45] Date of Patent: Apr. 13, 1993

[54] IMAGE RECORDING APPARATUS

[75] Inventors: Kunio Hakkaku, Ashigarakami; Satoshi Morita, Ayase; Susumu Tomoda, Ayase; Akira Masuda, Ayase; Shinji Odagiri, Ayase, all of Japan

[73] Assignee: Fuji Photo Film Co., Ltd., Kanagawa, Japan

[21] Appl. No.: 769,304

[22] Filed: Oct. 1, 1991

[30] Foreign Application Priority Data

| | | | |
|---|---|---|---|
| Oct. 1, 1990 | [JP] | Japan | 2-263485 |
| Mar. 20, 1991 | [JP] | Japan | 3-056552 |
| May 27, 1991 | [JP] | Japan | 3-121468 |

[51] Int. Cl.[5] ..... B41J 1/50

[52] U.S. Cl. ..... 400/150; 400/82

[58] Field of Search ..... 400/82, 185, 186, 187, 400/323, 120, 149, 150, 151

[56] References Cited

U.S. PATENT DOCUMENTS

| | | | |
|---|---|---|---|
| 2,980,227 | 4/1961 | Handley | 101/90 |
| 4,204,779 | 5/1980 | Lee et al. | 400/82 |
| 4,576,490 | 3/1986 | Isobe | 400/82 |
| 5,013,168 | 5/1991 | Yokota et al. | 400/323 |
| 5,018,884 | 5/1991 | Hirano et al. | 400/82 |

FOREIGN PATENT DOCUMENTS

| | | | |
|---|---|---|---|
| 005775 | 1/1981 | Japan | 400/82 |
| 56-10188 | 3/1981 | Japan . | |
| 61-11276 | 1/1986 | Japan . | |
| 61-72570 | 4/1986 | Japan . | |
| 192572 | 8/1986 | Japan | 400/82 |
| 227075 | 10/1986 | Japan | 400/82 |
| 280970 | 12/1986 | Japan | 400/82 |
| 179776 | 7/1988 | Japan | 400/82 |

*Primary Examiner*—Edgar S. Burr
*Assistant Examiner*—Ren Yan
*Attorney, Agent, or Firm*—Sughrue, Mion, Zinn, Macpeak & Seas

[57] ABSTRACT

Disclosed herein is an image recording apparatus which comprises first and second recording heads each used to record a visible image on a recording medium, and a drive mechanism capable of moving the first and second recording heads in the direction which intersects the direction in which the recording medium is fed and in the directions in which they are spaced from each other while respective processes for recording the visible image on the recording medium by the first and second recording heads are being carried out simultaneously.

5 Claims, 12 Drawing Sheets

IMAGE RECORDING APPARATUS

BACKGROUND OF THE INVENTION

1. Field of the Invention

The present invention relates to an image recording apparatus capable of efficiently recording a visible image on a recording sheet (recording medium).

2. Description of the Related Art

There has heretofore been known, for example, a thermosensitive or thermal transfer type image recording apparatus of a type wherein a recording head having a thermal head is moved in the direction which intersects the direction in which a recording sheet is fed, thereby recording a desired visible image on the recording sheet.

When a recording sheet (whose size is of, for example, A1 or A0) which is relatively large in size is used, the width of the recording sheet—i.e., the length of the recording sheet with respect to the direction in which the recording head is moved—is elongated, thereby causing the problem that the time required to record an image on the recording sheet is long.

In order to record the image on the recording sheet at a high speed, there has been proposed an image recording apparatus of a type wherein a plurality of recording heads are disposed in such a manner that they are spaced at predetermined intervals, and these recording heads are integrally moved in the same direction as the transverse direction of a recording sheet.

In such a conventional image recording apparatus, however, the plurality of recording heads are moved in the same direction as the transverse direction of the recording sheet. Therefore, the recording sheet is pressed by these recording heads, thereby allowing the recording sheet to be pushed in the direction of the recording heads. Thus, the conventional image recording apparatus has the problem that crumples or wrinkles are formed on the recording sheet so as to create an image-unrecordable portion thereof, so that an image recording process cannot be carried out with high accuracy.

There is also known an image recording apparatus of a type wherein while a pair of printing heads is being moved in such a manner as to approach each other from transversely-extending both sides of a recording sheet, the recording of an image from one end of the recording sheet to its central portion is carried out by using one of the printing heads, and thereafter the recording of an image from the central portion to the other end thereof is performed by making use of the other of the printing heads while the printing heads are being moved in the directions away from each other (see Japanese Patent Application Publication No. 56-10188). This image recording apparatus has, however, the problem that when it is desired to move the pair of printing heads in the direction to approach each other, the recording sheet can be bunched toward its center so as to form wrinkles thereon, thereby creating image-unrecorded portions on the recording sheet when it is desired to record the image on the recording sheet by one printing head referred to above. In addition, the image recording processes are alternately carried out by one of the printing heads and the other thereof as described above, thereby causing the problem that such image recording processes cannot be performed at a high speed.

In the thermal transfer type image recording apparatus, as well, a thermal transfer film is superimposed on a recording sheet while the thermal transfer film is being intermittently fed by a friction clutch of a feed mechanism. Under this condition, the recording head is used to record an image on the recording sheet.

However, when the delivery of the thermal transfer film is stopped, the tensile force exerted on the thermal transfer film is reduced, thereby often forming wrinkles or the like thereon. When the image recording process is done by using the recording head under this condition, there arises the undesirable condition that an image is not recorded owing to the presence of the wrinkles or the like, i.e., a so-called "void" occurs, thereby reducing the quality of an image.

Therefore, there has been proposed an image recording apparatus of a type wherein electric motors are respectively disposed on the side of a feeding unit for feeding a thermal transfer film to a recording head and on the side of a retracting unit for retracting the thermal transfer film from the side of the recording head, and these motors are energized to apply predetermined tension to the thermal transfer film (see Japanese Patent Application Laid-Open Nos. 61-11276 and 61-72570, for example).

However, in the conventional image recording apparatuses referred to above, there are disposed dedicated motors on the sides of the feeding unit and the retracting unit. Therefore, each image recording apparatus is rendered complex in structure, and the manufacturing cost of the entire apparatus is greatly increased.

SUMMARY OF THE INVENTION

It is therefore a general object of the present invention to provide an image recording apparatus capable of easily carrying out an efficient image recording process and highly accurately performing an image recording process without omission of image recording.

It is a principal object of the present invention to provide an image recording apparatus capable of reliably preventing wrinkles or the like from being formed on a thermal transfer film during its withdrawal.

It is another object of the present invention to provide an image recording apparatus comprising, first and second recording heads each used to record a visible image on a recording medium, and a drive mechanism capable of moving the first and second recording heads in the direction which intersects the direction in which the recording medium is fed and in the directions in which they are spaced from each other while respective processes for recording the visible image on the recording medium by the first and second recording heads are being carried out simultaneously.

It is a further object of the present invention to provide the image recording apparatus wherein the drive mechanism includes moving means for moving the first and second recording heads in the directions in which they approach each other and are spaced from each other and for supporting the second recording head so as to be displaceable by a predetermined distance, and holding means for holding said second recording head against said first recording head so as to enable said second recording head to be moved integrally with said first recording head.

It is a still further object of the present invention to provide the image recording apparatus wherein the moving means includes an endless timing belt having different side portions on which the first and second recording heads respectively are to be mounted, and the holding means has a compression spring used to press the second recording head toward the first recording head.

It is a still further object of the present invention to provide the image recording apparatus wherein the moving means includes the endless timing belt having the different side portions on which the first and second recording heads respectively are to be mounted, and the holding means includes a tension spring used to pull the second recording head toward the first recording head.

It is a still further object of the present invention to provide the image recording apparatus wherein the moving means includes the endless timing belt having the different side portions on which the first and second recording heads respectively are to be mounted, and the holding means includes an interlocking hook swingably mounted on the first recording head so as to enable the second recording head to be held against the first recording head.

It is a still further object of the present invention to provide an image recording apparatus comprising a pair of recording heads for superimposing a thermal transfer film on a recording medium so as to record a visible image thereon, and a feed mechanism for intermittently feeding the thermal transfer film, said feed mechanism including resilient members for applying the tensile force to the thermal transfer film when the thermal transfer film is intermittently fed so as to record a visible image on the recording medium by said recording heads.

It is a still further object of the present invention to provide the image recording apparatus wherein the feed mechanism includes a feeding unit for feeding the thermal transfer film to the recording heads and a retracting unit for retracting the thermal transfer film from the side of the recording heads, the retracting unit having resilient members and a friction clutch.

It is a still further object of the present invention to provide the image recording apparatus wherein the feed mechanism includes the feeding unit for feeding the thermal transfer film to the recording heads and the retracting unit for taking up the thermal transfer film from the side of the recording heads, the feeding unit having resilient members and a friction clutch.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

Figure 2:
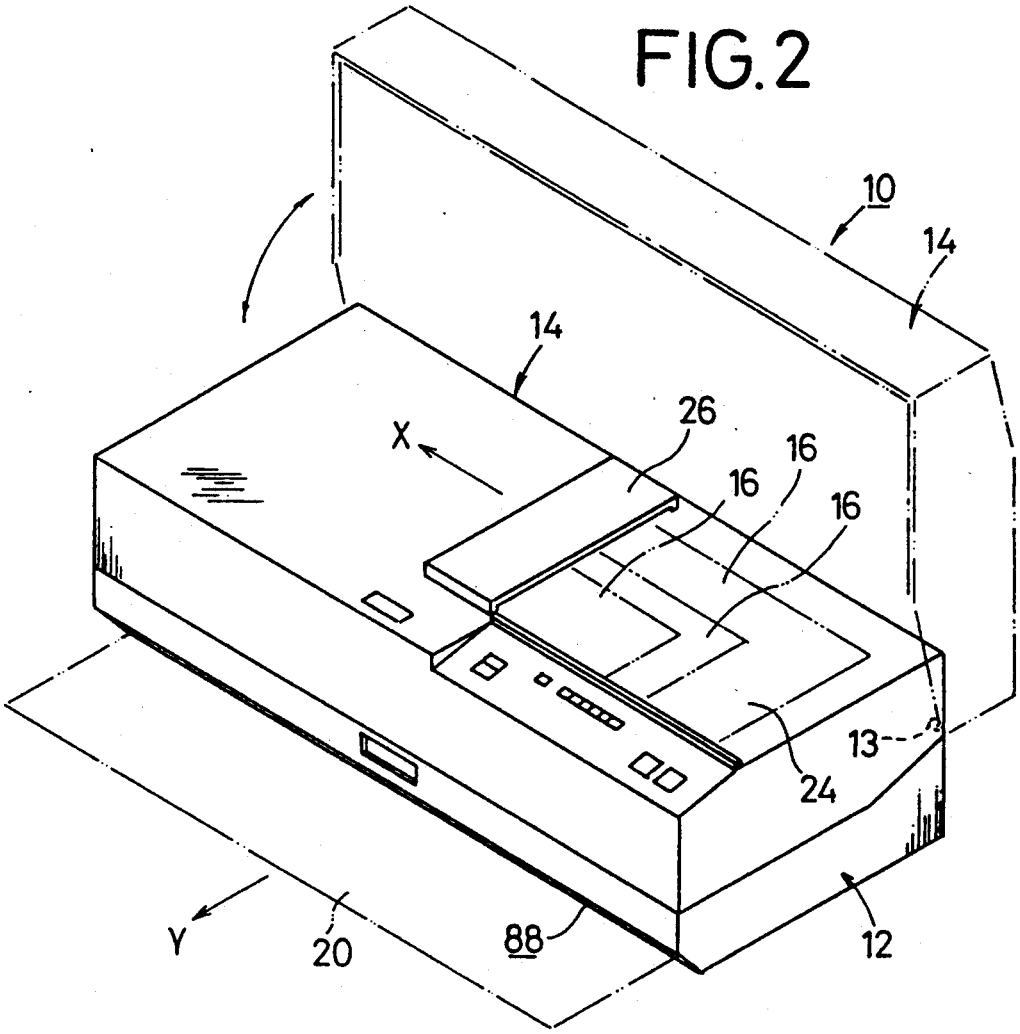
FIG. 2 is a perspective view of a structure of the image recording apparatus.
Figure 3:
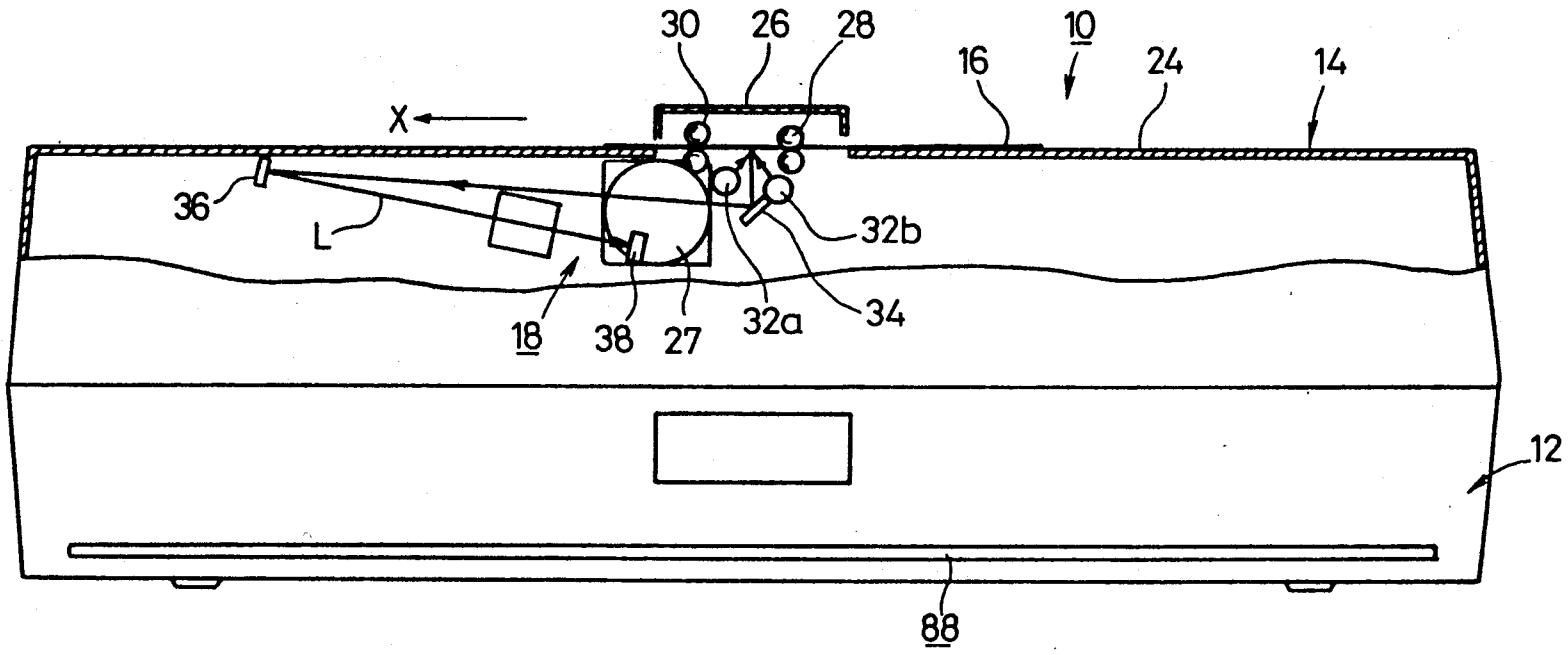
FIG. 3 is a front view, partly in cross section, of the image recording apparatus.
Figure 4:
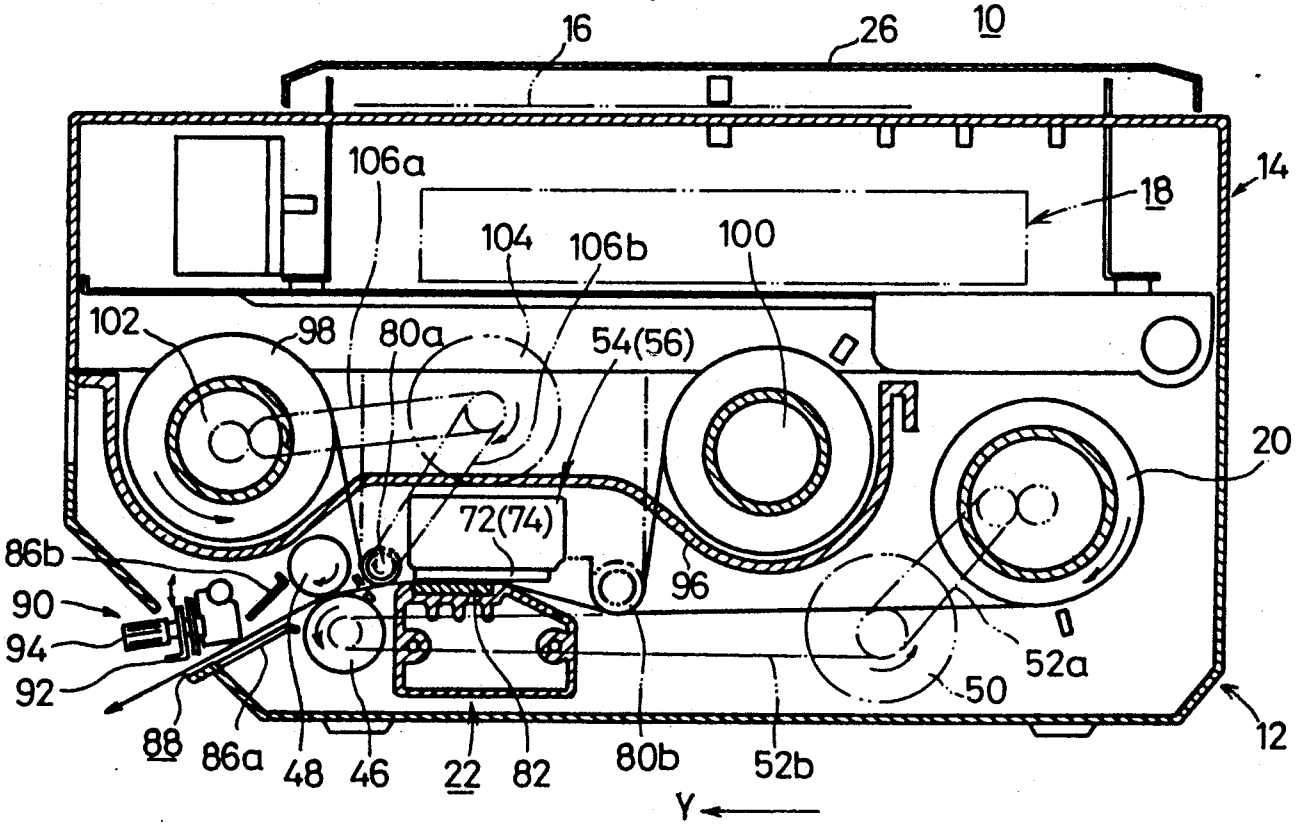
FIG. 4 is a longitudinal side view of the image recording apparatus.

Referring to FIGS. 2 through 4, designated at numeral 10 is an image recording apparatus according to a first embodiment of the present invention. The image recording apparatus 10 adopts a so-called clamshell structure comprising a lower cover member 12 and an upper cover member 14 mounted on the lower cover member 12 in such a manner that it can be opened and closed about a support, i.e., a fulcrum 13. In addition, the image recording apparatus 10 includes a reading unit 18 for reading information carried by an original 16 to be read while the original 16 is being fed in the horizontal direction on the upper cover member 14, and a recording unit 22 for enlarging the so-read information and reproducing the same on a recording sheet (recording medium) 20. The reading unit 18 and the recording unit 22 are disposed on upper and lower sides respectively. In addition, the direction (indicated by the arrow X) in which the original 16 is fed and the direction (indicated by the arrow Y) in which the recording sheet 20 is fed intersect with each other.

The upper cover member 14 has an original placement portion 24 for placing thereon the original to be read. The leading end of the original 16 placed on the original placement portion 24 enters a scanner cover 26.

As shown in FIG. 3, there are disposed, within the scanner cover 26 at a predetermined interval, two pairs of rollers 28 and 30 each of which constitutes an auxiliary scanning means and rotatably driven by a rotative drive source 27. In addition, the reading unit 18 is disposed below the roller pairs 28 and 30.

The reading unit 18 has light sources 32*a* and 32*b* for applying illuminating light to the surface of the original 16 by which information is carried. The light sources 32*a* and 32*b* extend in a main scanning direction (i.e., in the direction indicated by the arrow Y) normal to an auxiliary scanning direction (i.e., in the direction indicated by the arrow X). Then, light L, which is firstly emitted from each of the light sources 32*a* and 32*b* and then reflected by the original 16, is reflected by reflecting mirrors 34 and 36 and applied to a CCD sensor 38.

As illustrated in FIG. 4, a roll of recording sheet 20 as a roll of thermal transfer sheet is accommodated in the lower cover member 12. In addition, the leading end of the recording sheet 20 is pulled up to the recording unit 22 so as to be held between a feed roller 46 and a nip roller 48. The recording sheet 20 and the feed roller 46 are rotated in synchronism with each other by timing belts 52*a* and 52*b* coupled to a motor 50.

Figure 1:
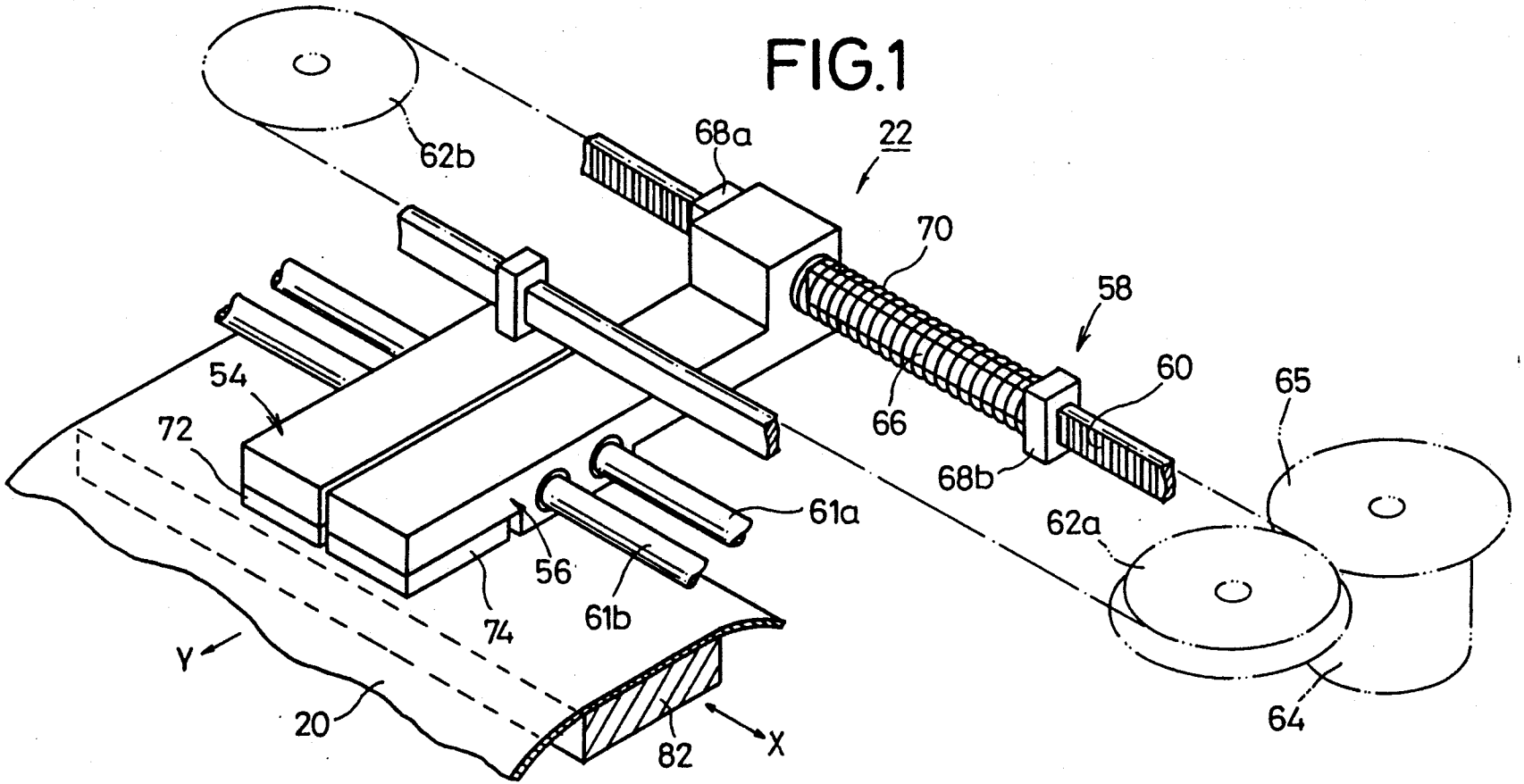
FIG. 1 is a fragmentary perspective view of an image recording apparatus according to a first embodiment of the present invention.

As shown in FIG. 1, the recording unit 22 comprises first and second recording heads 54 and 56 each of which is used to record a visible image on the recording sheet 20, and a drive mechanism 58 capable of moving the first and second recording heads 54 and 56 in the direction (i.e., in the direction indicated by the arrow X) which intersects the direction in which the recording sheet 20 is fed and in the directions in which they are moved away from each other while the visible image is being recorded thereon simultaneously by the first and second recording heads 54 and 56.

The drive mechanism 58 is used to move the first and second recording heads 54 and 56 in the directions in which the first and second recording heads 54 and 56 approach each other and are moved away from each other. In addition, the drive mechanism 58 has an endless timing belt (conveying or moving means) 60 used to support the second recording head 56 in such a manner that it can be displaced by a predetermined distance, and guide rollers 61*a* and 61*b*. Both ends of the timing belt 60 are trained around pulleys 62*a* and 62*b* respectively, and the pulley 62*a* is rotated via a gear train 65 by a pulse motor 64. The first recording head 54 is fixed to the timing belt 60, and the timing belt 60 is provided with a guide bar 66 having a predetermined length and stoppers 68*a* and 68*b*. In addition, there is mounted, on the guide bar 66, a compression spring 70 as a holding means for holding the second recording head 56 against the first recording head 54 so as to enable the second recording head 56 to be moved in unison with the first recording head 54.

The first and second recording heads 54 and 56 are provided with thermal heads 72 and 74 respectively. In addition, heating elements 76 and 78 of the thermal heads 72 and 74 are spaced a predetermined interval from each other (see FIG. 5).

The recording unit 22 and donor feed rollers 80*a* and 80*b* are held on the side of the upper cover member 14, and a flat plate-shaped platen 82 is disposed below the thermal heads 72 and 74.

One ends of a pair of guide plates 86*a* and 86*b* are disposed near the feed roller 46 and the nip roller 48, whereas the other ends thereof face a recording sheet outlet 88 defined in the lower cover member 12. The outlet 88 is provided with a cutter means 90 used to cut the recording sheet 20. The cutter means 90 has a guide rail 92 extending in the direction indicated by the arrow X and a cutter 94 moved along the guide rail 92.

There is accommodated a roll of donor film (a roll of thermal transfer film) 98 in a cassette 96 above the recording unit 22. The donor film 98 is wound on a donor film feeding core member 100 and a donor film retracting core member 102. The retracting core member 102 and the donor feed roller 80*a* are rotated and driven in synchronism with each other by timing belts 106*a* and 106*b* coupled to a motor 104.

A description will now be made of the operation of the image recording apparatus 10.

Referring first to FIG. 3, the original 16 to be read is placed on the original placement portion 24 of the upper cover member 14, and the reading unit 18 is then activated. Thus, the roller pairs 28 and 30 are rotated to feed the original 16 in the direction indicated by the arrow X, i.e., in the auxiliary scanning direction. Under this condition, the light sources 32*a* and 32*b* are energized to apply the illuminating light to the original 16. The light L reflected by the information surface of the original 16 is reflected by the reflecting mirrors 34 and 36 so as to be applied to the CCD sensor 38. Then, the information carried by the original 16 is photoelectrically converted into an electric signal by the CCD sensor 38, and the photoelectrically converted information is then electrically read.

The electrically read information is delivered to the recording unit 22, and the motor 50 is then energized so as to feed the recording sheet 20 in the direction indicated by the arrow Y.

Figure 5:
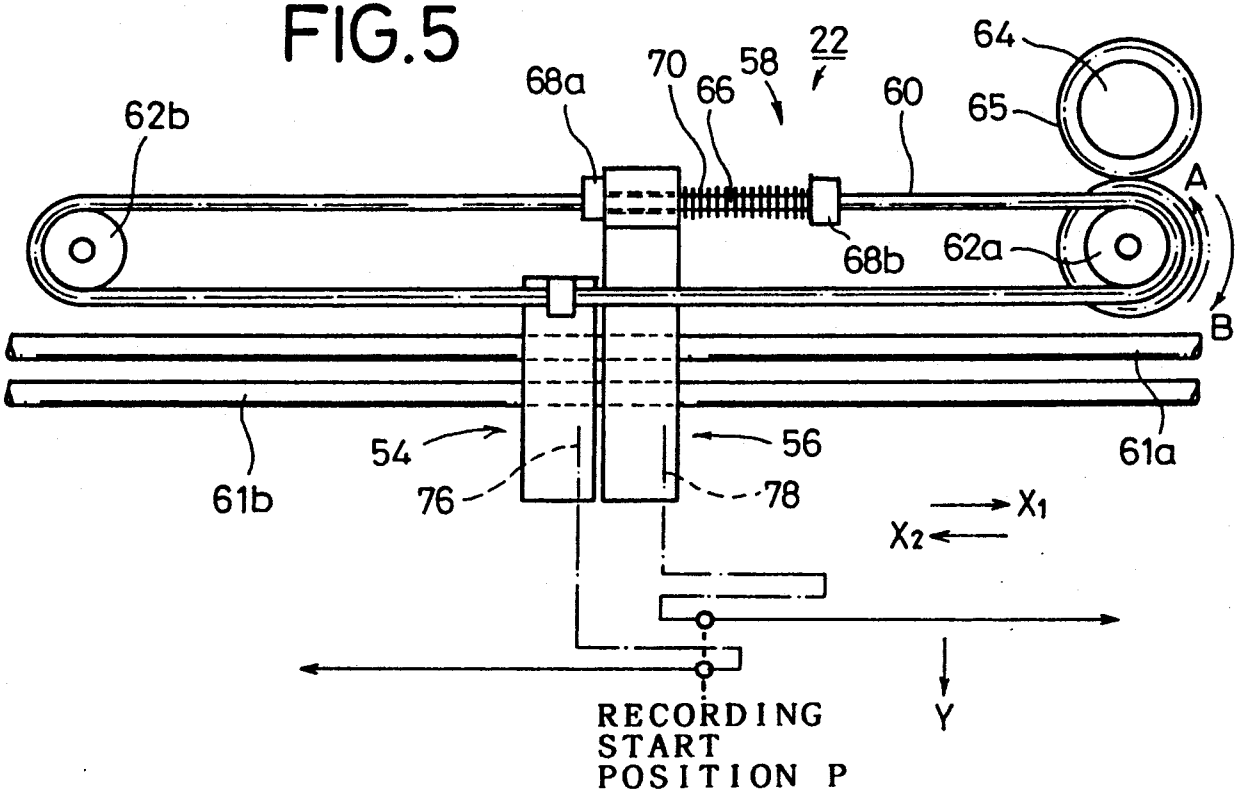
FIG. 5 is a plan view for describing the operation of a recording unit of the image recording apparatus.

Then, a pulse motor 64 of the recording unit 22 is energized to cause the gear train 65 to rotate the pulley 62*a* in the direction indicated by the arrow A in FIG. 5, i.e., in the direction to cause the first recording head 54 to approach the second recording head 56. Therefore, the first recording head 54 is pressed to move the second recording head 56 toward the stopper 68*b* (i.e., in the direction indicated by the arrow $X_1$) against the compression spring 70.

After the first and second recording heads 54 and 56 are moved in the direction indicated by the arrow $X_1$ in unison with each other and the heating element 76 of the first recording head 54 passes through a recording start position P, the pulse motor 64 is reversed to rotate the pulley 62*a* in the direction indicated by the arrow B. Therefore, the first recording head 54 is moved in the direction indicated by the arrow $X_2$, and hence the compression spring 70 is pressed to move the second recording head 56 along the guide rail 66 toward the stopper 68*a*, i.e., in the direction indicated by the arrow $X_2$.

When the heating element 76 of the thermal head 72, which is mounted on the first recording head 54, reaches the recording start position P, the thermal head 72 is activated so as to generate heat from the heating element 76, thereby making a start in the recording process with respect to the recording sheet 20.

On the other hand, when the second recording head 56 is held in engagement with the stopper 68*a*, the second recording head 56 is moved away from the first recording head 54 so as to be displaced in the direction indicated by the arrow $X_1$. When the heating element 78 of the thermal head 74 reaches the recording start position P, the heating element 78 is heated so that the recording process with respect to the recording sheet 20 is carried out.

In the present embodiment, the image recording processes with respect to the recording sheet 20 are performed simultaneously while the first and second recording heads 54 and 56 are being displaced by the drive mechanism 5 in the directions away from each other. Thus, since the recording sheet 20 is pressed toward both ends thereof, the recording sheet 20 is not bunched or shifted toward either one of both ends thereof or toward the center thereof as in cases where an image recording process is carried out while a plurality of recording heads are being moved in the same direction and an image recording process is performed while a pair of printing heads is being moved toward the center of a recording sheet. It is therefore possible to efficiently prevent crumples, i.e., wrinkles or the like from being formed on the recording sheet 20 and reliably prevent image information from being unrecorded on the recording sheet 20 due to the occurrence of partly-formed unrecordable regions on the recording sheet 20, thereby making it possible to achieve an image recording process with high accuracy.

In addition, the second recording head 56 is movably disposed in such a manner that it is spaced a predetermined distance from the timing belt 60 by way of the compression spring 70 and the stoppers 68a and 68b. Therefore, the image recording process can reliably be carried out from the recording start position P through the respective heating elements 76 and 78 by energizing and controlling the pulse motor 64 as described above.

In the present embodiment as well, the image recording processes are simultaneously carried out while the first and second recording heads 54 and 56 are being moved from a substantially central portion of the recording sheet 20 to both ends thereof. It is therefore possible to immediately record an image on a recording sheet without any difficulty as compared with a conventional example in which an image recording process is performed while a pair of printing heads is being driven alternately, thereby making it possible to bring about an advantageous effect that the image recording processes can efficiently and easily be carried out. When it is unnecessary to record an image to the extent of both ends of the recording sheet 20, the first and second recording heads 54 and 56 are moved toward the center of the recording sheet 20 after they reach a region on the recording sheet 20 necessary for the recording of an image, whereby the image recording processes by the first and second recording heads 54 and 56 can be carried out efficiently at once and at a high speed.

Then, the motor 104 is energized to rotate the retracting core member 102 and the donor feed roller 80a so that the donor film 98 is successively fed from the feeding core member 104. In addition, ink to be put on the donor film 98 is melted by the thermal heads 72, 74 and the platen 82 so as to be thermally transferred onto the recording sheet 20, thereby reproducing a desired image thereon.

The recording sheet 20, on which the image has been reproduced, firstly passes between the feed roller 46 and the nip roller 48 and then passes through the guide plates 86a and 86b, after which it is discharged from the outlet 88 of the lower cover member 12 to the outside. When the recording sheet 20 is discharged to reach a predetermined portion, the operator moves the cutter 94 along the guide rail 92 and then cuts the recording sheet 20.

Incidentally, the present embodiment has described a case in which the thermal transfer sheet is used as the recording sheet 20. However, thermosensitive paper may be used in place of the thermal transfer sheet. Since the donor film 98 is unnecessary at this time, it may be taken off from the lower cover member 12 integrally with the cassette 96.

Figure 6:
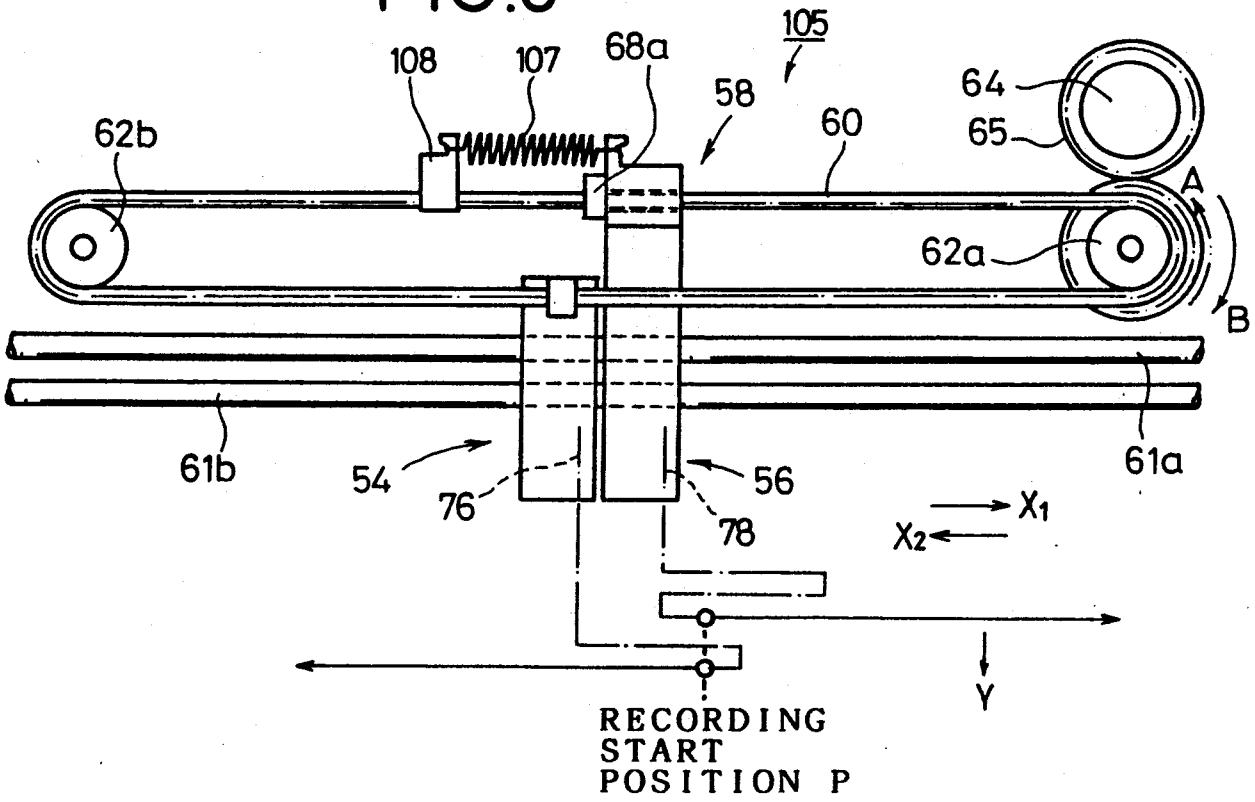
FIG. 6 is a plan view for describing the operation of a recording unit of an image recording apparatus according to a second embodiment of the present invention.

FIG. 6 shows a recording unit 105 of an image recording apparatus according to a second embodiment. Incidentally, reference numerals of the recording unit 105, which are identical to those of the recording unit 22 employed in the first embodiment, denote the same elements of structure as those of the recording unit 22, and their detailed description will therefore be omitted.

The recording unit 105 comprises a tension spring 107 serving as a holding means and an interlocking member 108 fixedly mounted on the timing belt 60. One end of the tension spring 107 is held against the interlocking member 108, whereas the other end thereof is fixed to the second recording head 56. Thus, the recording unit 105 according to the second embodiment can bring about the same operations and advantageous effects as those of the recording unit 22 because the second recording head 56 is pressed toward the stopper 68a and supported thereon under the tension of the tension spring 107. In particular, it is unnecessary to provide a stopper between the second recording head 56 and the pulley 62a, thereby making it possible to obtain an advantage that the overall length of the recording unit 105 extending in the direction indicated by the arrow X can be shortened.

Figure 8:
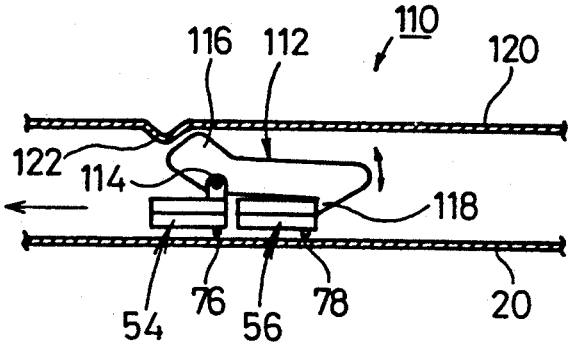
FIG. 8 is a schematic side view of the recording unit shown in FIG. 7.
Figure 7:
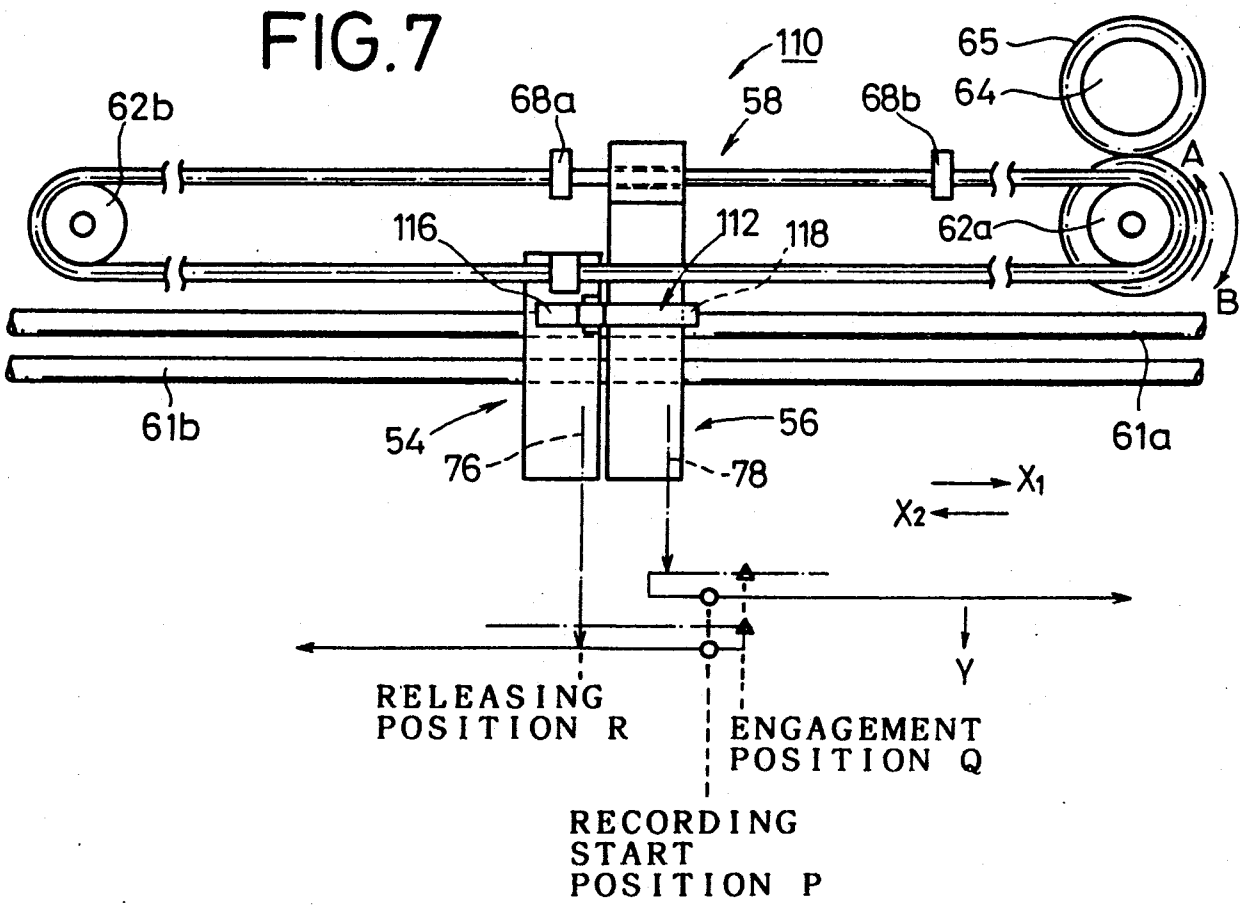
FIG. 7 is a plan view for describing the operation of a recording unit of an image recording apparatus according to a third embodiment of the present invention.

FIGS. 7 and 8 each show a recording unit 110 of an image recording apparatus according to a third embodiment. Incidentally, reference numerals of the recording unit 110, which are identical to those of the recording unit 22 employed in the first embodiment, show the same elements of structure as those of the recording unit 22, and their detailed description will therefore be omitted.

The recording unit 110 has an interlocking hook 112 serving as a holding means, which is swingably supported by the first recording head 54 via a shaft 114. The interlocking hook 112 has a protrusion 116 which is disposed in a position near the shaft 114 and extends upward, and a hook portion 118 which extends toward the second recording head 56 and is capable of holding a side portion of the second recoding head 56. In addition, there is disposed a guide plate 120 above the interlocking hook 112. The guide plate 120 has a convex-shaped portion 122 defined therein, which is brought into engagement with the protrusion 116 of the interlocking hook 112 (see FIG. 8).

In this arrangement, when the pulse motor 64 is energized to first rotate the pulley 62a in the direction indicated by the arrow A, the first recording head 54 is moved in the direction indicated by the arrow $X_1$, and the second recording head 56 is moved in the direction indicated by the arrow $X_2$ under the pressure of the stopper 68b. When the first and second recording heads 54 and 56 reach an alignment or engagement position Q, the interlocking hook 112 is brought into mating engagement with the second recording head 56 so as to be swung upward about the shaft 114. Therefore, the second recording head 56 is held against the first recording head 54 by the hook portion 118 of the interlocking hook 112.

Then, the pulse motor 64 is reversed to rotate the pulley 62a in the direction indicated by the arrow B, thereby integrally moving the first recording head 54 and the second recording head 56 held against the first recording head 54 by the interlocking hook 112 in the direction indicated by the arrow $X_2$. When the heating element 76 of the first recording head 54 passes through the recording start position P and reaches a releasing position R, the protrusion 116 of the interlocking hook 112 engages the convex-shaped portion 122 of the guide plate 120, so that the interlocking hook 112 is swung upwardly about the shaft 114. Therefore, the second recording head 56 is released from being held against the first recording head 54 by the interlocking hook 112. Thus, only the first recording head 54 is moved in the direction indicated by the arrow $X_2$, and the second recording head 56 is engaged with the stopper 68a and moved in the direction indicated by the arrow $X_1$. As a consequence, the image recording processes can simultaneously be carried out while the first and second recording heads 54 and 56 are being moved in the directions away from each other.

Then, an image recording apparatus according to a fourth embodiment of the present invention will herein-after be described in detail with reference to the accompanying drawings.

Figure 10:
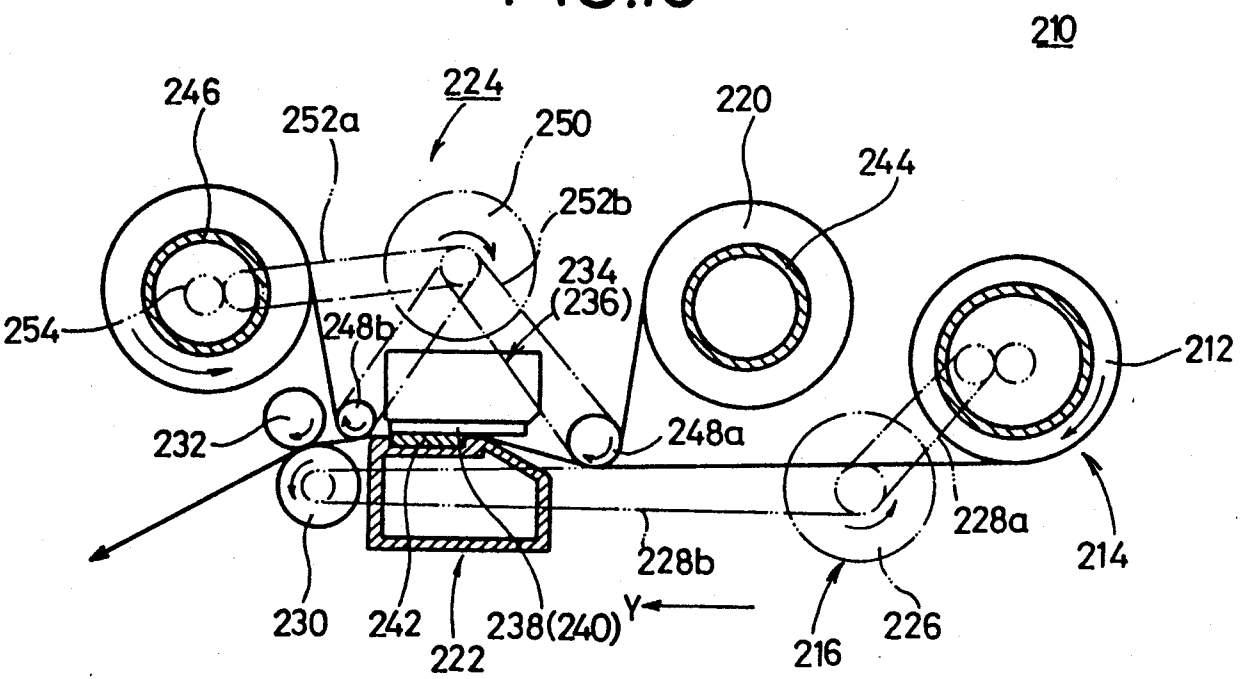
FIG. 10 is a schematic view of the image recording apparatus depicted in FIG. 9.

Referring to FIG. 10, designated at numeral 210 is the image recording apparatus according to the fourth embodiment. The image recording apparatus 210 comprises an accommodating unit 214 for accommodating a roll of recording sheet (recording medium) 212 therein, a recording sheet feed mechanism 216 for holding or supporting the leading end of the recording sheet 212 so as to feed the same in the direction indicated by the arrow Y, a roll-shaped donor film (thermal transfer film) 220, a recording unit 222 for superimposing the donor film 220 on the recording sheet 212 so as to record an image thereon, and a delivery mechanism 224 for intermittently delivering the donor film 220 in synchronism with the delivery of the recording sheet 212.

The recording sheet feed mechanism 216 has a motor 226, and serves to rotate a feed roller 230 and a nip roller 232 in unison with each other by timing belts 228*a*, 228*b* coupled to the motor 226.

The recording unit 222 includes first and second recording heads 234 and 236 each of which is used to record a visible image on the recording sheet 212. The first and second recording heads 234 and 236 are moved in the direction (i.e., in the direction indicated by the arrow Y) which intersects the direction in which the recording sheet 212 is fed and in the directions in which they are moved away from each other and approach each other. In addition, thermal heads 238 and 240 are mounted in lower parts of the first and second recording heads 234 and 236 respectively, and a flat plate-shaped platen 242 is disposed below the thermal heads 238 and 240.

The donor film 220 is wound on a donor film feeding core member 244 and a donor film retracting core member 246. In addition, the donor film 220 is trained around donor feed rollers 248*a* and 248*b* on both sides of the recording unit 222. The delivery mechanism 224 has a motor 250. In addition, the delivery mechanism 224 is activated to rotate the retracting core member 246 and the donor feed roller 248*a* in unison with each other by timing belts 252*a* and 252*b* coupled to the motor 250.

Figure 9:
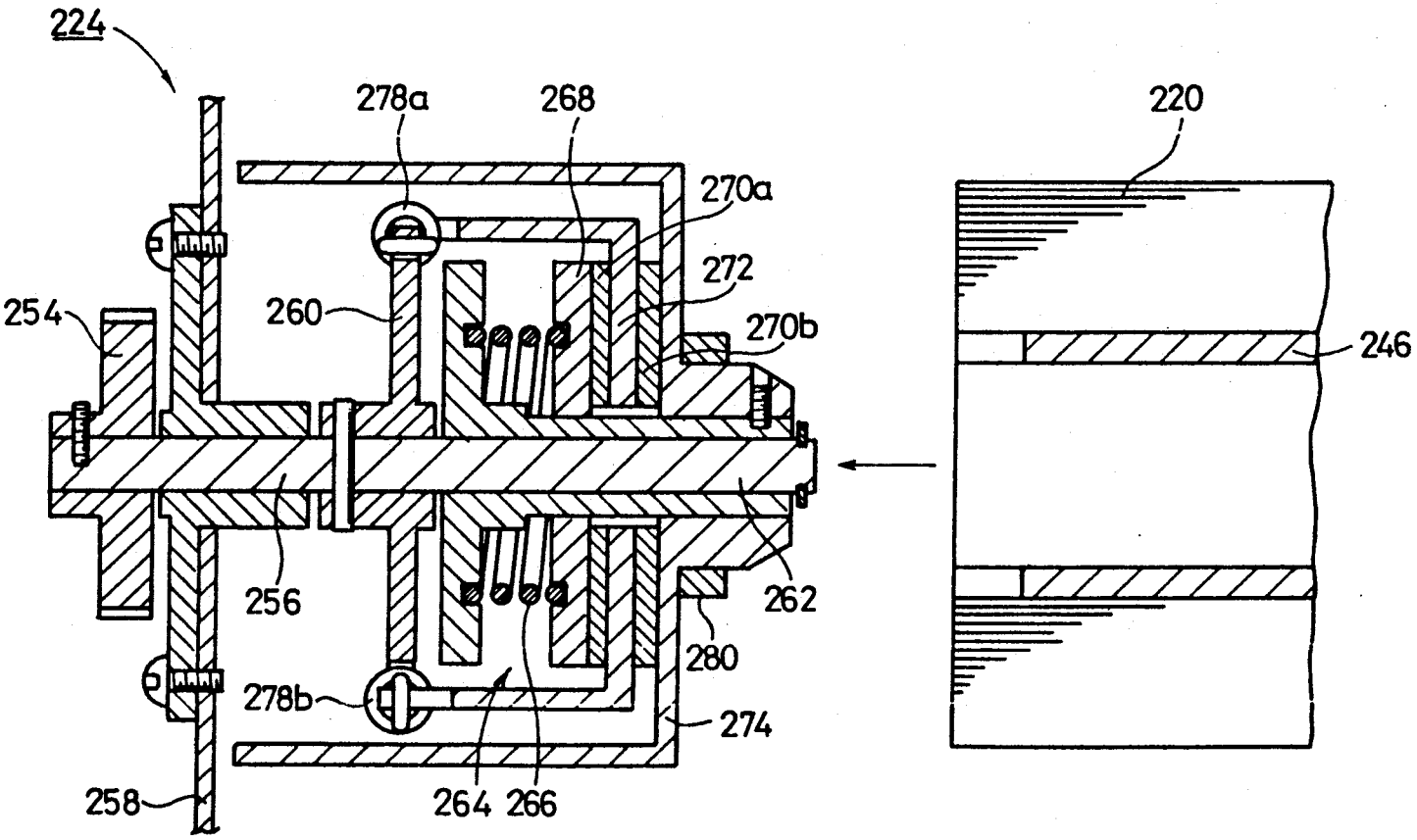
FIG. 9 is a longitudinal cross-sectional view of an essential part of an image recording apparatus according to a fourth embodiment of the present invention.

As shown in FIG. 9, a gear 254 rotated and driven by the timing belt 252*a* is fixed onto a rotatable shaft 256. The rotatable shaft 256 is rotatably supported by a frame 258 and fixedly mounts an arm member 260 thereon. A pressure cylindrical body 262 is rotatably mounted onto the rotatable shaft 256. In addition, the pressure cylindrical body 262 is held in engagement with one end of a compression spring 266 of a friction clutch 264, whereas a pressure plate 268 is held in engagement with the other end thereof. The pressure plate 268 has a cavity centrally defined therein, which is shaped in the form of an oval. Further, the pressure plate 268 is fitted into an oval-shaped hole defined in an outer peripheral wall of the pressure cylindrical body 262. Furthermore, the pressure plate 268 freely slides in the direction in which it is pressurized, and is rotated in unison with the pressure cylindrical body 262. There are also disposed, around the pressure plate 268, friction materials 270*a*, 270*b*, a friction cylinder 272 and a rotatable cylinder 274. In addition, stoppers 276*a* and 276*b* are formed in opposite ends of the friction cylinder 272 in a state in which they project from the friction cylinder 272, and tension springs (resilient members) 278*a* and 278*b* are held in engagement with the ends of the friction cylinder 272 and both ends of the arm member 260 (see FIG. 11). The direction, in which the tension springs 278*a* and 278*b* are engaged with the ends of the friction cylinder 272 and both ends of the arm member 260, is brought into alignment with the direction in which they extend at the time that the retracting and feeding operations of the donor film 220 are carried out. In addition, the rotatable cylinder 274 has a protrusion 280 to which the retracting core member 246 is fixed.

The operation of the image recording apparatus 210 constructed as described above will now be described below.

Referring to FIG. 10, the motor 226 is energized to feed the recording sheet 212 by a predetermined length in the direction indicated by the arrow Y. Then, the motor 250 of the delivery mechanism 224 is energized to cause the timing belts 252*a*, 252*b* to rotate the retracting core member 246 and the donor feed roller 248*a* in unison with each other.

Figure 11:
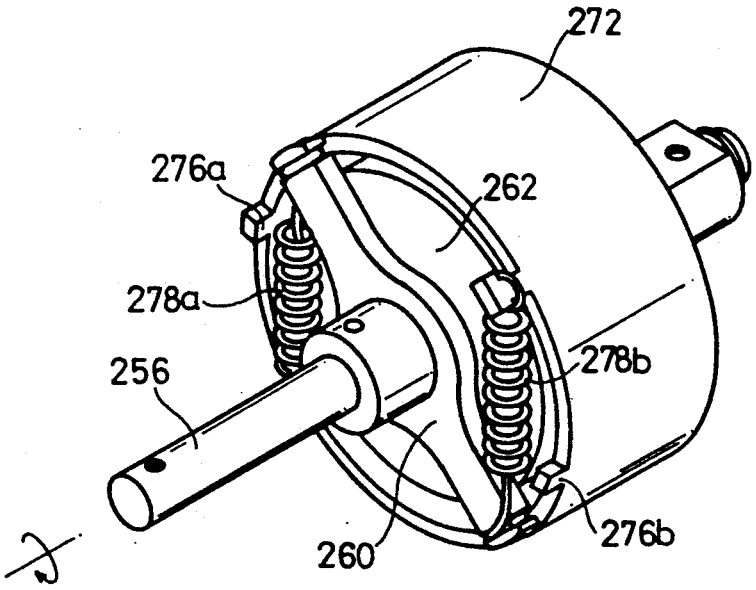
FIG. 11 is a fragmentary perspective view of the image recording apparatus.

Described more specifically, when the rotatable shaft 256 for fixing the gear 254 is rotated in the direction indicated by the arrow in FIG. 11 in a state in which the rotatable shaft 256 is supported by the frame 258, as illustrated in FIG. 9, the arm member 260 secured to the rotatable shaft 256 is turned in the direction indicated by the arrow in unison with the rotatable shaft 256. Therefore, the friction cylinder 272 is rotated in the arrow direction under the tension of the tension springs 278*a*, 278*b* which are respectively held in engagement with both ends of the arm member 260. In addition, the rotatable cylinder 274 is rotatably driven integrally with the retracting core member 246 by the friction clutch 264 so as to feed the donor film 220 by a certain amount in the direction indicated by the arrow Y, followed by de-energization of the motor 250.

Thus, the first and second recording heads 234 and 236 of the recording unit 222 are moved in the direction which intersects the direction indicated by the arrow Y as viewed from the original position and in the directions different from each other. Since the thermal heads 238 and 240 have already been activated at this time, a start in the process of recording an image on the recording sheet 212 is made by way of the donor film 220.

In the present embodiment, the friction cylinder 272 is held in engagement with the arm member 260 by the tension springs 278*a* and 278*b*. When the motor 250 is de-energized, both ends of the arm member 260 are spaced from the stoppers 276*a* and 276*b* of the friction cylinder 272 as illustrated in FIG. 11. Thus, the tensile force of each of the tension springs 278*a* and 278*b* is exerted on the friction cylinder 272, and hence the tensile force acts on the donor film 220 taken up by the retracting core member 246 mounted on the friction cylinder 272.

Figure 12A:
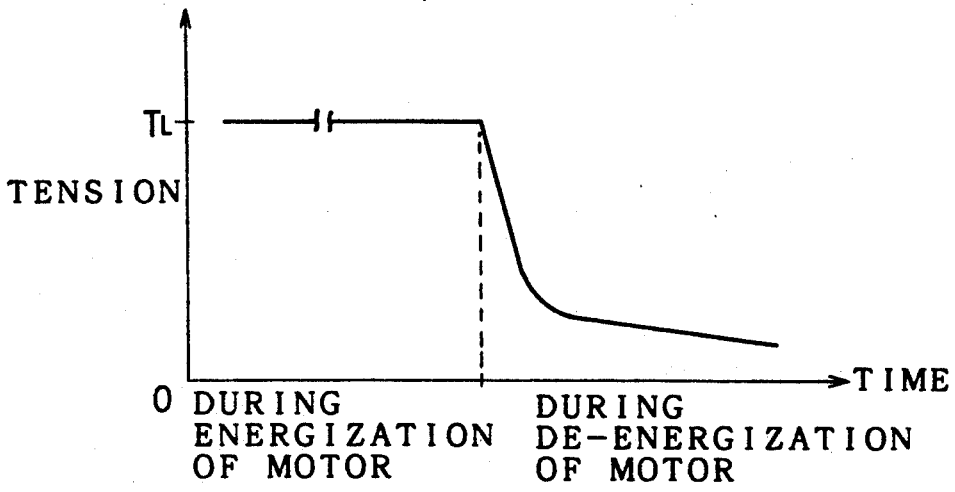
FIGS. 12*a*–12*b* are diagrams for describing the tension exerted on a donor film at the time that a motor is energized and de-energized.
Figure 12B:
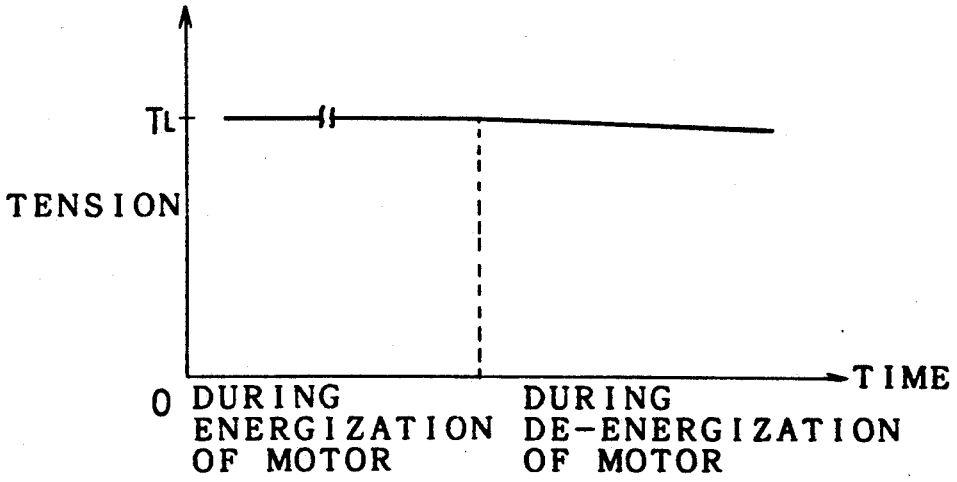

A description will now be made of the action referred to above with reference to FIG. 12. FIG. 12*a* shows the relationship between the tension exerted on the donor film owing to a mechanism having only a conventional friction clutch while a motor is being energized, and the tension exerted on the donor film in a state in which the motor is de-energized. In the conventional example referred to above, it is understood that when the motor is being energized, the tension produced by the frictional force of the friction clutch is kept constant, whereas when the motor is de-energized, the tension exerted on the donor film is greatly reduced owing to the elongation of the donor film itself and the slippage of the friction clutch on its friction surface. On the other hand, FIG. 12*b* shows the tension exerted on the donor film 220 employed in the present embodiment when the donor film 220 is delivered and undelivered. Thus, given tension is reliably exerted on the donor film 220 at the time of its undelivery by the tension springs 278*a* and 278*b*, thereby making it possible to prevent wrinkles or the like from being formed on the donor film 220 in the recording unit 222. As a result, an image free of void or the like can highly accurately be recorded on the recording sheet 12 by the recording heads 234 and 236.

In particular, when it is desired to move the recoding heads 234 and 236 in the direction which intersects the direction (indicated by the arrow Y) in which the donor film 220 is fed, during an interval in which the delivery of the donor film 220 is stopped, the donor film 220 would tend to form wrinkles or the like thereon according to the displacement of each of the recording heads 234 and 236. However, in the present embodiment, predetermined tension is applied to the donor film 220 by the tension springs 278*a* and 278*b*. It is therefore possible to reliably prevent any wrinkles from being formed on the donor film 220 even when the recording heads 234 and 236 are slid, thereby enabling an efficient image recording process.

Further, the tension springs 278*a* and 278*b* may simply be held in engagement with the arm member 260 fixed to the rotatable shaft 256 and the friction cylinder 272. Thus, the above-described arrangement can also bring about advantageous effects in that the respective mechanisms can be simplified and the manufacturing cost of the present apparatus can greatly be reduced as compared with the conventional arrangement that dedicated motors should be disposed on both sides, i.e., a donor film feeding side and a donor film retracting side.

Figure 13:
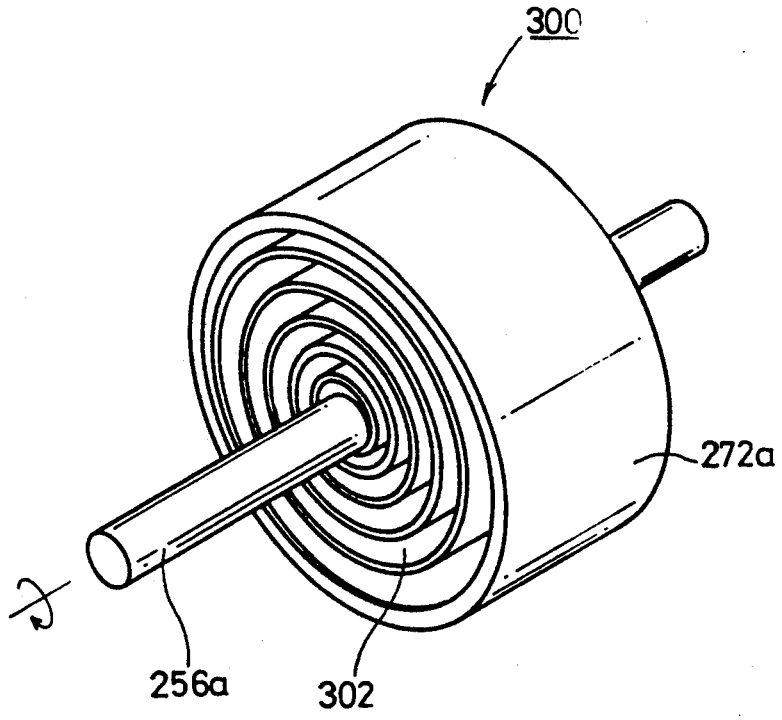
FIG. 13 is a fragmentary perspective view of a feed mechanism employed in an image recording apparatus according to a fifth embodiment of the present invention.

FIG. 13 shows an essential part of a feed mechanism 300 employed in an image recording apparatus according to a fifth embodiment. The feed mechanism 300 is constructed in such a manner that both ends of a spiral spring 302 are held in engagement with a rotatable shaft 256*a* and a friction cylinder 272*a* without using the arm member 260 of the delivery mechanism 224. Accordingly, the feed mechanism 300 having the spiral spring 302 can bring about the same operations and effects as those of the delivery mechanism 224. As an alternative to the spiral spring 302, a torsion spring (not shown) may be used.

Further, if the timing belt 252*b* is trained around the donor feed roller 248*b*, and the tension springs 278*a*, 278*b* and the friction clutch 264 shown in FIGS. 9 and 11 are disposed on the donor feed roller 248*a*, followed by fixing of the rotatable shaft 256 to the frame 258, then the tensile force can be applied to the donor film 220 in the direction opposite to the direction indicated by the arrow Y when the motor 250 is de-energized, thereby making it possible to more reliably prevent wrinkles or the like from being formed on the donor film 220. Furthermore, if the tension springs 278*a*, 278*b* and the friction clutch 264 shown in FIGS. 9 and 11 are attached to the feeding core member 244, and the rotatable shaft 256 is secured to the frame 258, then the donor film 220 can smoothly be wound on the feeding core member 244 under the allowable elongation of each of the tension springs 278*a*, 278*b* when it is desired to reversely feed the donor film 220, e.g., when it is desired to retract a part of a free or unexposed donor film which has the full surface free or devoid of data to be recorded and which passes through the recording unit 222 in order to make good use of its part.

Incidentally, the image recording process is carried out by making use of each of the slidable thermal heads in the aforementioned embodiments. However, it is needless to say that the use of fixed line-type thermal heads is also effective when the motor 250 such as a pulse motor is intermittently energized.

The image recording apparatus according to the present invention can bring about the following advantageous effects.

Since the image recording processes are simultaneously carried out while the first and second recording heads are being moved in the direction which intersects the direction in which the recording sheet is fed and in the directions in which they are moved away from each other, an improvement in the efficiency of such image recording processes can be easily achieved.

Further, the image recording process is performed when the first and second recording heads are displaced in the directions away from each other. Therefore, the recording sheet is not bunched toward one direction or its central portion while the image recording process is being carried out. It is thus possible to reliably prevent image information from being unrecorded on the recoding sheet due to the formation of wrinkles or the like thereon, thereby making it possible to achieve image recording processes highly accurately and efficiently.

Furthermore, according to the present invention, the thermal transfer film is intermittently fed by the feed mechanism, and the tensile force is exerted on the thermal transfer film by the resilient members when the image recording processes are carried out by the recording heads. It is therefore possible to prevent any wrinkle or the like from being formed on the thermal transfer film in a simple structure. Even when the recording heads slide on the thermal transfer film upon undelivery of the thermal transfer film in particular, any wrinkle or the like is not formed on the thermal transfer film, thereby making it possible to record an image on a recording medium with high accuracy and more efficiently.

Having now fully described the invention, it will be apparent to those skilled in the art that many changes and modifications can be made without departing from the spirit or scope of the invention as set forth herein.

What is claimed is:

1. An image recording apparatus comprising:

first and second recording heads each used to record a visible image on a recording medium; and a drive means for moving said first and second recording heads along a first axis which intersects a second axis along which said recording medium is fed, said driving means moving said first recording head in a first direction along the first axis and said second recording head in a direction opposite the first direction, such that said first and second recording heads retreat from each other while simultaneously and independently recording a visible image on the recording medium.

2. An image recording apparatus according to claim 1, wherein said drive means includes:

moving means for:

moving said first recording head in a second direction along the first axis and said second recording head in a direction opposite to the second direction, such that said first and second recording heads approach each other, and supporting said second recording head, such that said second recording head is displacable along said first axis by a predetermined distance, and holding means for holding said second recording-head against said first recording head so as to enable said second recording head to be moved integrally with said first recording head.

3. An image recording apparatus according to claim 2, wherein:

said moving means includes an endless timing belt having a first and a second side portion on which said first and said second recording heads are respectively mounted, and said holding means includes a compression spring to press said second recording head toward said first recording head.

4. An image recording apparatus according to claim 2, wherein:

said moving means includes an endless timing belt having a first and a second side portion on which said first and said second recording heads are respectively mounted, and said holding means includes a tension spring to pull said second recording head toward said first recording head.

5. An image recording apparatus according to claim 2, wherein:

said moving means includes an endless timing belt having a first and a second side portion on which said first and said second recording heads are respectively mounted, and said holding means includes an interlocking hook swingably mounted on said first recording head so as to enable said second recording head to be held against said first recording head.

* * * * *